United States Patent [19]

Davey et al.

[11] Patent Number: 4,709,631

[45] Date of Patent: Dec. 1, 1987

[54] METHOD OF PRINTING A RAISED PATTERN OF LIQUID

[75] Inventors: Raymond G. Davey, Lancaster; Martin Dees, Jr., Landisville; Daniel M. Sigman, Jr., Strasburg, all of Pa.

[73] Assignee: Armstrong World Industries, Inc., Lancaster, Pa.

[21] Appl. No.: 4,873

[22] Filed: Jan. 20, 1987

[51] Int. Cl.[4] ..... B41F 15/42

[52] U.S. Cl. ..... 101/129; 101/120

[58] Field of Search ..... 101/120, 119, 129; 118/213, 406; 427/282

[56] References Cited

U.S. PATENT DOCUMENTS

| | | | |
|---|---|---|---|
| 1,541,787 | 6/1925 | Cadgene et al. | 101/120 |
| 3,613,635 | 10/1971 | Brehm | 101/119 X |
| 3,921,521 | 11/1975 | Kudlich | 101/120 |
| 3,933,093 | 1/1976 | Vertegaal | 101/120 |

FOREIGN PATENT DOCUMENTS

| | | | |
|---|---|---|---|
| 54628 | 9/1981 | European Pat. Off. | 101/120 |
| 46755 | 4/1981 | Japan | 101/120 |
| 46782 | 4/1981 | Japan | 101/120 |

*Primary Examiner*—Clifford D. Crowder

[57] ABSTRACT

The invention is directed to a method of printing a pattern on a substrate, the liquid retained within the printing screen is in a first position directly above the point of tangency between the screen and substrate so that a lesser quantity of liquid is deposited to provide raised beads of liquid comparable in size to the size of the apertures of the screen.

The reservoir of liquid is shifted away from the point of tangency and therefore a larger quantity of liquid passes through the apertures because the apertures are now spaced from the substrate. The larger quantities of liquid flow together and therefore, a pattern is provided larger than the aperture size of the screen.

1 Claim, 3 Drawing Figures

Fig. 1
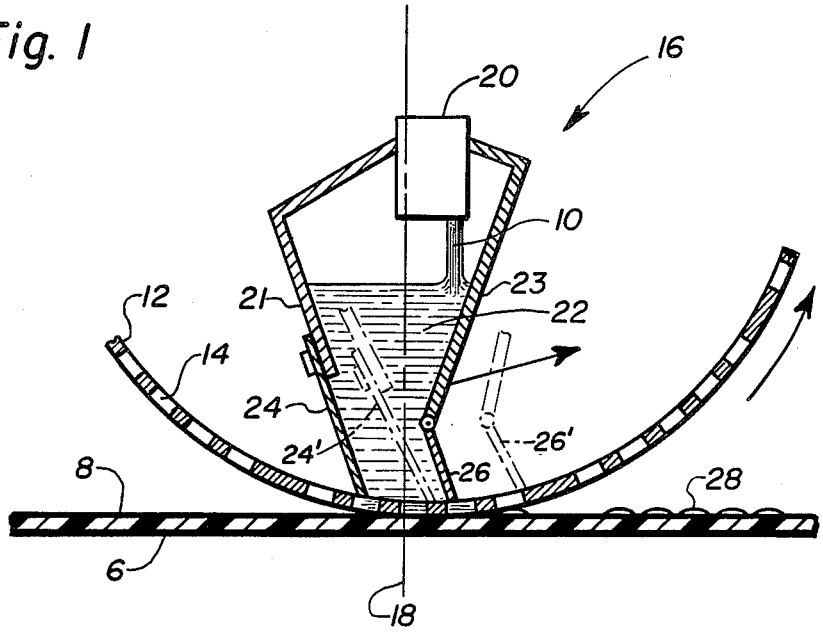
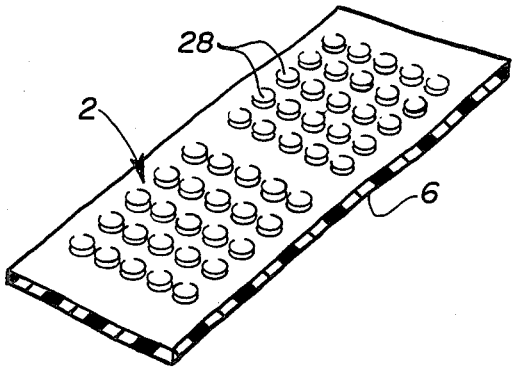
Fig. 2
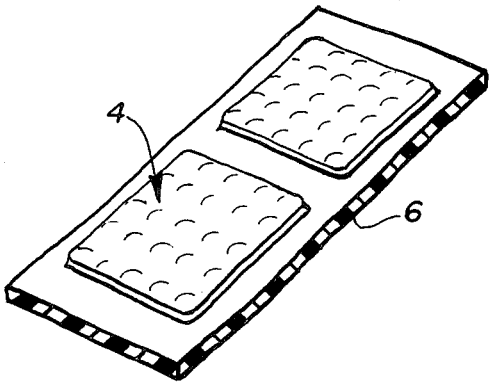
Fig. 3

METHOD OF PRINTING A RAISED PATTERN OF LIQUID

BACKGROUND OF THE INVENTION

1. Field of the Invention

The invention is directed to a method of printing a raised pattern of liquid on a non-porous substrate. Depending upon the position of the reservoir of liquid within the printer, the pattern printed can be the same as the pattern of the printer screen or the resulting pattern may be an enlargement of the pattern of the printer screen.

2. Description of the Prior Art

U.S. Pat. No. 3,921,521 is directed to a printer with a printing screen and reservoir therein used for the purpose of printing a liquid.

The printer of the patent is normally used to print on a porous substrate and the liquid which passes through one aperture of the screen tends to blend with material passing through an adjacent aperture.

SUMMARY OF THE INVENTION

The invention is directed to a method of printing a raised pattern on a substrate. Th substrate has non-porous surface and it receives a pseudo plastic thixotropic liquid that provides a raised bead of liquid which is in the shape of the aperture of the printer screen. The printer screen is placed tangent to the substrate and the reservoir of liquid within the screen is positioned at a first position directly above the point of tangency. There is printed a plurality of raised beads of liquid on the substrate which are substantially the same size as the apertures in the screen.

By shifting the reservoir of liquid within the screen from the first position to a point in the direction of screen movement so that the reservoir of liquid is offset from the point of tangency, the pattern printed will not retain the definition of the apertures of the screen. Shifting the reservoir of liquid causes more liquid to pass through each aperture and the liquid will laterally flow so that a number of beads of liquid flow together to form an enlarged pattern of raised liquid.

BRIEF DESCRIPTION OF THE DRAWING

FIG. 1 is an end view of the printer and substrate; and

FIG. 2 is a perspective of one printed pattern; and

FIG. 3 is a perspective view of another printed pattern.

DESCRIPTION OF THE PREFERRED EMBODIMENT

There is disclosed herein a method of printing a raised pattern 2 or 4 on a substrate 6. The substrate is provided with a non-porous surface to receive a pseudo plastic thixotropic liquid 10 that, at a first quantity of deposition, will not have noticeable lateral flow of the liquid and will yield a bead of raised liquid that will retain the geometric design of the apertures of the print screen. At a second larger quantity of deposition, the liquid will have a noticeable lateral flow so that a number of beads of raised liquid will flow together to form a different larger pattern of liquid 4 due to the shear weight of the extra deposited liquid which causes the lateral flow.

There is first provided a substrate to be printed with the substrate having a non-porous surface 8 to receive the printed liquid 10. A printer 16 is provided with a circular screen 12 having apertures 14 therein. The apertures are of the desired geometric design and size to be printed in the pattern of FIG. 2. The screen is placed tangent to and above the substrate. Positioned wthin the screen is a source of liquid 20 which feeds liquid downward to form a reservoir 22 of liquid. The reservoir is retained within a wall structure 21 and 23 which has, at the lower ends thereof, blades 24 and 26. The blades are resilient and blade 24 is adjustable positioned on the wall 21 and blade 26 is pivoted to wall 23. The lower ends of the blades 24 and 26 rub against the inside of the screen 12 and there is retained the reservoir of liquid between the two blades.

In FIG. 1, line 18 represents the point of tangency between the screen 12 and the substrate 6 and it can be seen that the reservoir 22 of liquid 10 is within the screen and at a first position directly above the point where the screen is tangent to the substrate. Movement of the screen 12 and the substrate 6 will result in the depositing of a first quantity of liquid on the substrate and the amount of liquid deposited will yield a bead 28 of liquid on the substrate. The bead will retain a geometric design and size comparable to that of the aperture in the screen. Th rheology of the pseudo plastic thixotropic liquid 10 is controlled so that there is no more than 10% to 50% lateral flow of the liquid once it is deposited on the substrate. The moving of the substrate and the screen together in a continuous manner will deposit a plurality of beads of liquid on the substrate while the screen and substrate are in contact. Because of the wiping action of the blades 24 and 26, it can be seen that the amount of liquid deposited is basically the amount of liquid that can be held within an aperture with a thickness for the liquid equal to the thickness of the wall of the screen.

It is possible to move the retained reservoir of liquid within the screen from its first position directly above the point where the screen is tangent to the substrate, to a second position with the reservoir of liquid offset in the direction of screen movement. This is shown by the partial views of blade 24' and blade 26' which define the second position of the retained liquid offset from the point of tangency which is shown by line 18. The moving of the substrate and screen together in a continuous manner will deposit a plurality of beads of liquid of a larger quantity of liquid than was deposited when the reservoir was in its first position. This occurs because the deposition of liquid is occurring partly at the time the screen and substrate are not in contact and therefore, the quantity of liquid being deposited is greater than the volume of apertures. The second larger quantity of liquid is deposited and the liquid will have a noticeable lateral flow so that a number of beads of liquid flow together to form the pattern of FIG. 3. It can be seen in FIG. 3 that there is formed a pattern of raised liquid larger than and of a different shape from the apertures of the screen. The flow occurs because the larger quantity of liquid will have a shear weight which will cause lateral flow of the liquid.

What is claimed is:

1. A method of printing a raised pattern on a substrate, said substrate being provided with a nonporous surface to receive a pseudo plastic thixotropic liquid that, at a first quantity of deposition will not have noticeable lateral flow and will yield a bead of liquid that will retain a geometric design the same as the print screen aperture, but at a second larger quantity of deposition will have noticeable lateral flow to have a number of beads of liquid flow together to form a different larger pattern of liquid due to the shear weight of the extra deposited liquid causing lateral flow, the steps comprising:

(a) providing a substrate to be printed with the substrate having a nonporous surface to receive the printed liquid;

(b) providing a printer with a circular screen having apertures therein of a desired design and size;

(c) positioning said screen tangent to and above said substrate;

(d) positioning within said screen a source of liquid which feed to a reservoir of liquid;

(e) retaining the reservoir of liquid within the screen at a first position directly above the point where the screen is tangent to the substrate so that a first quantity of liquid is deposited on the substrate and the amount of liquid deposited will yield a bead of liquid on the substrate that it retains a geometric design and size comparable to that of the aperture in the screen;

(f) moving the substrate and screen together in a continuous manner to deposit a plurality of beads of liquid onto the substrate while the screen and substrate are in contact;

(g) moving the retained reservoir of liquid within the screen from its first position directly above the point where in the screen is tangent to the substrate, to a second position where the reservoir of liquid is offset, in the direction of screen movement; and (h) moving the substrate and screen together in a continuous manner to deposit a plurality of beads of liquid of a larger quantity of liquid than would have been deposited when the reservoir was in its first position since deposition of liquid is occurring partly at the time the screen and substrate are not in contact so that the larger quantity of liquid is deposited and the liquid will have noticeable lateral flow to cause a number of beads of liquid to flow together to form a pattern of raised liquid larger than and of a different shape from the apertures of the screen.

* * * * *